US007938916B2

(12) United States Patent
Uesugi et al.

(10) Patent No.: US 7,938,916 B2
(45) Date of Patent: May 10, 2011

(54) ALUMINUM ALLOY SHEET FOR LITHOGRAPHIC PRINTING PLATE AND METHOD OF PRODUCING THE SAME

(75) Inventors: Akio Uesugi, Shizuoka (JP); Atsushi Matsuura, Shizuoka (JP); Hiroshi Ougi, Tokyo (JP); Atsushi Hibino, Tokyo (JP)

(73) Assignees: Fujifilm Corporation, Tokyo (JP); Sumitomo Light Metal Industries, Ltd., Tokyo (JP)

( * ) Notice: Subject to any disclaimer, the term of this patent is extended or adjusted under 35 U.S.C. 154(b) by 0 days.

(21) Appl. No.: 12/157,869

(22) Filed: Jun. 13, 2008

(65) Prior Publication Data

US 2009/0014103 A1 Jan. 15, 2009

(30) Foreign Application Priority Data

Jul. 10, 2007 (JP) ..... 2007-180710

(51) Int. Cl.
*C22C 21/00* (2006.01)

(52) U.S. Cl. ..... 148/437; 420/548; 420/551; 420/554

(58) Field of Classification Search ..... 148/437; 420/548, 551, 554
See application file for complete search history.

(56) References Cited

U.S. PATENT DOCUMENTS

2005/0013724 A1* 1/2005 Ougi et al. ..... 420/532
2009/0252642 A1* 10/2009 Uesugi et al. ..... 420/530

FOREIGN PATENT DOCUMENTS

JP 08337835 A * 12/1996

* cited by examiner

*Primary Examiner* — Roy King
*Assistant Examiner* — Janelle Morillo
(74) *Attorney, Agent, or Firm* — Flynn, Thiel, Boutell & Tanis, P.C.

(57) ABSTRACT

An aluminum alloy sheet for a lithographic printing plate is obtained by homogenizing an ingot of an aluminum alloy at 500 to 610° C. for one hour or more, the aluminum alloy containing 0.03 to 0.15% of Si, 0.2 to 0.6% of Fe, 0.005 to 0.05% of Ti, and 2 to 30 ppm of Pb, with the balance being aluminum and unavoidable impurities, subjecting the homogenized product to rough hot rolling, a start temperature of the rough hot rolling being 430 to 500° C. and a finish temperature of the rough hot rolling being 400° C. or more, holding the product subjected to rough hot rolling for 60 to 300 seconds after the completion of the rough hot rolling to recrystallize the surface of the product, and subjecting the resulting product to finish hot rolling that is finished at 320 to 370° C. The aluminum alloy sheet has an average recrystallized grain diameter of 50 μm or less in a surface area in a direction perpendicular to a rolling direction, and has a Pb concentration 100 to 400 times an average Pb concentration in a surface area up to a depth of 0.2 μm from the surface of the aluminum alloy sheet.

5 Claims, No Drawings

ALUMINUM ALLOY SHEET FOR LITHOGRAPHIC PRINTING PLATE AND METHOD OF PRODUCING THE SAME

BACKGROUND OF THE INVENTION

1. Field of the Invention

The present invention relates to an aluminum alloy sheet for a lithographic printing plate. More particularly, the present invention relates to an aluminum alloy sheet for a lithographic printing plate which may be suitably surface-roughened by an electrochemical etching treatment and exhibits a high productivity, and a method of producing the same.

2. Description of Related Art

An aluminum alloy sheet is generally used as a support for a lithographic printing plate (including an offset printing plate). An aluminum alloy sheet used for a support is surface-roughened in order to improve its adhesion to a photosensitive film and improve its water retention in a non-image area. In recent years, a method that roughens the surface of an aluminum alloy sheet used for a support by an electrochemical etching treatment has been increasingly developed due to excellent plate-making applicability (fitness), excellent printing performance, and a continuous treatment capability using a coil material.

As an aluminum alloy sheet which can be relatively uniformly surface-roughened by electrolysis using an electrochemical etching treatment, an A1050 (aluminum purity: 99.5%) equivalent material or a material obtained by adding a small amount of alloy component to an A1050 equivalent material has been utilized. For example, a material containing a small amount of Pb (see JP-A-8-337835), and a material containing a small amount of Cu so that the Cu concentration in the surface area is higher than the Cu concentration in an area deeper than the surface area (see JP-A-2000-108534), have been proposed.

Such an aluminum alloy material for a lithographic printing plate has been produced by homogenizing an ingot, hot-rolling the homogenized product, cold-rolling the hot-rolled product while performing process annealing so that the surface of the rolled sheet has a recrystallized structure, and subjecting the cold-rolled product to secondary cold rolling, thereby ensuring uniform pit formation during an electrochemical etching treatment and preventing streaks when forming a printing plate. However, since a decrease in productivity and an increase in production cost necessarily occur due to process annealing, an improved production method has been desired.

A method that obtains an aluminum alloy sheet for a lithographic printing plate by cold-rolling a hot-rolled product without performing process annealing has been proposed (see JP-A-11-335761). In this method, hot rolling includes rough hot rolling and finish hot rolling. The start temperature of rough hot rolling is set at 450° C. or more. An aluminum alloy is subjected to rough hot rolling at a rolling speed of 50 m/min or more, a rolling reduction of 30 mm or more, or a single-pass rolling reduction rate of 30%. The finish temperature of rough hot rolling is set at 300 to 370° C. The finish temperature of finish hot rolling is set at 280° C. or more. The rolled product is then wound up in the shape of a coil to control the recrystallization state of the surface of the sheet.

SUMMARY OF THE INVENTION

In order to omit process annealing, it is necessary that an aluminum alloy sheet has been recrystallized when wound up in the shape of a coil after finish hot rolling. In order to obtain uniform electrolytic surface-roughening capability, it is important that recrystallized grains are minute and uniform in the same manner as in a material subjected to process annealing and the surface of the sheet is uniformly recrystallized.

In order to obtain an aluminum alloy material for a lithographic printing plate that ensures uniform and minute pit formation during an electrolytic treatment due to improved electrolytic properties, the inventors of the present invention conducted studies on the composition of an aluminum alloy material and conducted tests and studies on a production method in which process annealing is omitted. As a result, the inventors found that a material which contains Pb so that the Pb concentration in the surface area is higher than the Pb concentration in an area deeper than the surface area is advantageous, and that it is important to control the start temperature of rough hot rolling, the holding time from completion of rough hot rolling to finish hot rolling, and the finish temperature of finish hot rolling in order to produce an aluminum alloy sheet having such a structure without performing process annealing.

The present invention was conceived as a result of further tests and studies based on the above findings. An object of the present invention is to provide a method of producing an aluminum alloy sheet for a lithographic printing plate which ensures that the surface area of the sheet is uniformly recrystallized with minute and uniform recrystallized grains when the sheet is wound up in the shape of a coil after finish hot rolling, enables the sheet to be cold-rolled to a desired thickness without performing process annealing after hot rolling, achieves an appropriate Pb concentration in the surface area, ensures uniform pit formation during an electrochemical etching treatment, and does not produce streaks when forming a printing plate, and a method of producing an aluminum alloy sheet for a lithographic printing plate which enables an improvement in productivity and a reduction in production cost.

An aluminum alloy sheet for a lithographic printing plate according to a first aspect of the present invention which achieves the above object comprises 0.03 to 0.15% of Si, 0.2 to 0.6% of Fe, 0.005 to 0.05% of Ti, and 2 to 30 ppm of Pb, with the balance being aluminum and unavoidable impurities, the aluminum alloy sheet having an average recrystallized grain diameter of 50 μm or less in a surface area in a direction perpendicular to a rolling direction, and having a Pb concentration 100 to 400 times an average Pb concentration in a surface area up to a depth of 0.2 μm from the surface of the aluminum alloy sheet.

The above aluminum alloy sheet may further comprise 0.05% or less of Cu.

The above aluminum alloy sheet may further comprise less than 0.05% of Mg.

In the above aluminum alloy sheet, the number of precipitates having a particle diameter of 1 to 10 μm and the number of precipitates having a particle diameter of more than 10 μm distributed in a matrix may be 4000 to 10,000 per square millimeter ($mm^2$) and 100 or less per square millimeter ($mm^2$), respectively.

A method of producing an aluminum alloy sheet for a lithographic printing plate according to a second aspect of the present invention comprises homogenizing an ingot of the above aluminum alloy at 500 to 610° C. for one hour or more, subjecting the homogenized product to rough hot rolling, a start temperature of the rough hot rolling being 430 to 500° C. and a finish temperature of the rough hot rolling being 400° C. or more, holding the product subjected to the rough hot rolling for 60 to 300 seconds after completion of the rough hot rolling to recrystallize the surface of the product, subjecting the resulting product to finish hot rolling that is finished at 330° C. or more, and cold-rolling the resulting product at a reduction ratio of 80% or more.

According to the present invention, an aluminum alloy sheet for a lithographic printing plate which ensures that the surface area of the sheet is uniformly recrystallized with minute and uniform recrystallized grains when the sheet is wound up in the shape of a coil after finish hot rolling, enables the sheet to be cold-rolled to a desired thickness without performing process annealing after hot rolling, achieves an appropriate Pb concentration in the surface area, ensures uniform pit formation during an electrochemical etching treatment, and does not produce streaks when forming a printing plate, and a method of producing an aluminum alloy sheet for a lithographic printing plate which enables an improvement in productivity and a reduction in production cost, can be provided.

DETAILED DESCRIPTION OF THE INVENTION AND PREFERRED EMBODIMENTS

The meanings and the reasons for limitations to the components of the aluminum alloy sheet for a lithographic printing plate according to the present invention are described below. Fe produces Al—Fe intermetallic compounds, and produces Al—Fe—Si intermetallic compounds with Si. These compounds are dispersed to refine the recrystallization structure. These compounds serve as pit formation starting points so that pits are uniformly formed and are finely distributed during an electrolytic treatment. The Fe content is preferably 0.2 to 0.6%. If the Fe content is less than 0.2%, the distribution of the compounds may become non-uniform so that formation of pits may become non-uniform during an electrolytic treatment. If the Fe content exceeds 0.6%, coarse compounds may be produced, whereby the uniformity of the surface-roughened structure may decrease.

Si produces Al—Fe—Si intermetallic compounds with Fe. These compounds are dispersed to refine the recrystallization structure. These compounds serve as pit formation starting points so that pits are uniformly formed and are finely distributed during an electrolytic treatment. The Si content is preferably 0.03 to 0.15%. If the Si content is less than 0.03%, the distribution of the compounds may become non-uniform so that pit formation may become non-uniform during an electrolytic treatment. If the Si content exceeds 0.15%, coarse compounds may be produced. Moreover, Si tends to precipitate to decrease the uniformity of the surface-roughened structure.

Ti refines the ingot structure and the crystal grains. As a result, Ti ensures uniform pit formation during an electrolytic treatment to prevent streaks when forming a printing plate. The Ti content is preferably 0.005 to 0.05%. If the Ti content is less than 0.005%, Ti may not exhibit a sufficient effect. If the Ti content exceeds 0.05%, coarse Al—Ti compounds may be produced, whereby the surface-roughened structure may become non-uniform. When adding B together with Ti in order to refine the ingot structure, the Ti content is preferably 0.01% or less.

Pb is concentrated in a surface area and makes minute pits during an electrolytic treatment to improve the pit formation uniformity. This enables a desired pit pattern to be obtained. The Pb content is preferably from 2 to 30 ppm. If the PB content is less than 2 ppm, Pb may not exhibit a sufficient effect. If the Pb content exceeds 30 ppm, the surface-roughened structure may become non-uniform. It is preferable that the Pb concentration in a surface area up to a depth of 0.2 μm from the surface be 100 to 400 times the average Pb concentration.

Cu is easily dissolved in aluminum. When the Cu content is 0.05% or less, Cu exhibits a pit refinement effect. If the Cu content exceeds 0.05%, pits may become large and non-uniform during an electrolytic treatment.

Mg bonds to Si to form a compound, thereby suppressing precipitation of Si. If the Mg content is 0.05% or more, pits may become non-uniform during an electrolytic treatment. The Mg content is preferably 0.01 to 0.03%.

The aluminum alloy sheet for a lithographic printing plate according to the present invention is produced by casting an ingot of an aluminum alloy having the above composition by means of continuous casting or the like, and subjecting the resulting ingot to homogenization, hot rolling, and cold rolling. The present invention is characterized in that hot rolling includes rough hot rolling and finish hot rolling, and recrystallized grains when winding up the aluminum alloy sheet in the shape of a coil after finish hot rolling are controlled by specifying the rolling start temperature, the rolling finish temperature, and the holding time from rough hot rolling to finish hot rolling to obtain a sheet material having a desired thickness by cold rolling without performing process annealing after finish hot rolling.

Specifically, a non-uniform structure which may cause streaks is removed by facing the rolling-side surface of an ingot of an aluminum alloy having the above-described composition. The resulting product is subjected to a homogenization treatment at 500 to 610° C. for one hour or more. The homogenization treatment causes Fe and Si dissolved to supersaturation to uniformly precipitate. As a result, etch pits formed during an electrolytic treatment have a minute circular shape, whereby plate wear is improved. If the homogenization treatment temperature is less than 500° C., precipitation of Fe and Si may be insufficient. As a result, the pit pattern may become non-uniform. If the homogenization treatment temperature exceeds 610° C., the amount of Fe dissolved increases. As a result, the number of minute precipitates which serve as pit formation starting points decreases. If the homogenization treatment time is less than one hour, precipitation of Fe and Si may become insufficient, whereby the pit pattern may become non-uniform.

Hot rolling is normally carried out in a hot rolling line by subjecting the homogenized product to rough hot rolling on a rough rolling stand, transferring the rolled sheet to a finish rolling stand, subjecting the rolled sheet to finish hot rolling on the finish rolling stand, and winding up the hot-rolled sheet in the shape of a coil. In the present invention, rough hot rolling is started at 430 to 500° C. and finished at 400° C. or more. After the completion of rough hot rolling, the product subjected to rough hot rolling is held for 60 to 300 seconds before starting finish hot rolling on the finish rolling stand to recrystallize the surface of the product. A Pb concentration in a surface area up to a depth of 0.2 μm from the surface of 100 to 400 times the average Pb concentration can be achieved by holding the product subjected to rough hot rolling before starting finish hot rolling.

If the start temperature of rough hot rolling is less than 430° C., the number of rolling passes may increase due to an increase in deformation resistance, whereby productivity may decrease. If the start temperature of rough hot rolling exceeds 500° C., coarse recrystallized grains may be produced during rolling, whereby a streak-shaped non-uniform structure may be obtained. If the finish temperature of rough hot rolling is less than 400° C., recrystallization due to holding after rough hot rolling may become insufficient, whereby a uniform surface structure may not be obtained. Moreover, the above-mentioned Pb concentration may not be achieved. If the holding time from the completion of rough hot rolling to finish hot rolling is less than 60 seconds, recrystallization may become insufficient, whereby a uniform surface structure may not be obtained. Moreover, the above-mentioned Pb concentration may not be achieved due to a small difference between the Pb concentration in the surface area and the average Pb concentration. If the holding time exceeds 300 seconds, coarse recrystallized grains may be partially produced due to the growth of recrystallized grains, whereby minute recrystallized grains may not be obtained upon completion of hot rolling. Moreover, the above-mentioned Pb concentration may not be achieved.

The product subjected to rough hot rolling is subjected to finish hot rolling. Finish hot rolling is terminated at 320 to 370° C., and the resulting product is wound up in the shape of a coil. If the start temperature of finish hot rolling is less than 400° C., since the finish temperature of finish hot rolling decreases, recrystallization may become insufficient, whereby streaks may occur. If the finish temperature of finish hot rolling is less than 320° C., recrystallization may occur only partially, whereby streaks may occur. If the finish temperature of finish hot rolling exceeds 370° C., recrystallized grains may become large, whereby streaks may occur.

The product subjected to hot rolling is wound up in the shape of a coil to obtain a hot-rolled product of which the surface area has an average recrystallized grain size of 50 μm or less in the direction perpendicular to the rolling direction. Therefore, a sheet material having a desired thickness can be obtained by cold rolling the resulting product without performing process annealing after finish hot rolling. An improvement in productivity and a reduction in production cost can thus be achieved. Moreover, since the surface area of the final rolled sheet obtained by cold rolling has an average recrystallized grain size of 50 μm or less in the direction perpendicular to the rolling direction, the surface quality of the printing plate can be made uniform.

In the present invention, it is preferable that the number of precipitates having a particle diameter of 1 to 10 μm and the number of precipitates having a particle diameter of more than 10 μm distributed in the matrix be 4000 to 10,000 per square millimeter ($mm^2$) and 100 or less per square millimeter ($mm^2$), respectively. This precipitate distribution improves the dispersion uniformity of pits formed during an electrolytic treatment.

The precipitate distribution may be obtained by the combination of the above-mentioned homogenization treatment conditions (i.e., at 500 to 610° C. for one hour or more), the above-mentioned rough hot rolling conditions (i.e., start temperature: 430 to 500° C., finish temperature: 400° C. or more), and the above-mentioned holding conditions for the material subjected to rough hot rolling (i.e., held for 60 to 300 seconds before starting finish hot rolling after completion of rough hot rolling).

EXAMPLES

The present invention is described below by means of examples and comparison examples to demonstrate the effects of the present invention. Note that the following examples illustrate a preferred embodiment of the present invention, and the present invention is not limited to the following examples.

Example 1 and Comparative Example 1

An aluminum alloy having a composition shown in Table 1 was melted and cast. Each rolling-side surface of the resulting ingot was faced by 5 mm to reduce the thickness of the ingot to 500 mm. The ingot was then subjected to homogenization and hot rolling. The thickness of the aluminum alloy was reduced to 3 mm after finish hot rolling. The aluminum alloy was then wound in the shape of a coil. The hot-rolled product was cold-rolled to a thickness of 0.3 mm without performing process annealing. In Tables 1 and 2, values outside the conditions according to the present invention are underlined.

TABLE 1

| | Chemical composition | | | | | |
|---|---|---|---|---|---|---|
| Alloy | Pb (ppm) | Fe (mass %) | Si (mass %) | Cu (mass %) | Ti (mass %) | Mg (mass %) |
| A | 7 | 0.30 | 0.06 | 0.016 | 0.029 | 0.015 |
| B | 20 | 0.35 | 0.04 | 0.0003 | 0.007 | Less than 0.001 |
| C | 18 | 0.25 | 0.11 | 0.04 | 0.010 | Less than 0.001 |
| D | 25 | 0.40 | 0.10 | 0.0036 | 0.025 | Less than 0.001 |
| E | 1 | 0.45 | 0.05 | 0.01 | 0.006 | Less than 0.001 |
| F | 40 | 0.32 | 0.07 | 0.02 | 0.015 | Less than 0.001 |

TABLE 2

| | Homogenization treatment | | Rough hot rolling | Rough hot rolling | Holding | Finish hot rolling finish |
|---|---|---|---|---|---|---|
| Production condition | Temp. (° C.) | Time (h) | start temperature (° C.) | finish temperature (° C.) | time (s) | temperature (° C.) |
| a | 540 | 3 | 455 | 460 | 100 | 345 |
| b | 590 | 2 | 470 | 475 | 80 | 365 |
| c | 500 | 5 | 430 | 430 | 260 | 340 |
| d | 530 | 4 | 460 | 465 | 360 | 355 |
| e | 560 | 3 | 450 | 450 | 40 | 340 |
| f | 610 | 3.5 | 410 | 390 | 130 | 315 |
| g | 480 | 5.5 | 460 | 470 | 120 | 330 |

(Note)
Holding time: holding time before staring finish hot rolling after completion of rough hot rolling The average recrystallization particle diameter in the surface area of the cold-rolled sheet (specimen) in the direction perpendicular to the rolling direction was measured. The Pb concentration and the precipitate distribution in the surface area were evaluated. The results are shown in Table 3.

Measurement of average recrystallized grain size: After degreasing and washing the surface of the specimen, the surface of the specimen was mirror-polished and then anodized using Parker's reagent. The crystal grains were observed using an optical microscope in a polarization mode, and the crystal grain size in the direction perpendicular to the rolling direction was determined using an intercept method.

Pb concentration in the surface area: The Pb concentration in the surface area and the Pb concentration in the inner area were compared by performing Pb depth analysis (depth profile measurement) by secondary ion mass spectrometry (SIMS), and calculating the ratio of the highest Pb concentration count in the surface area and the highest Pb concentration count from the inside of the aluminum matrix.

Precipitate distribution: A backscattered electron image of the surface of each aluminum alloy sheet was observed at a magnification of 500 using a scanning electron microscope (SEM). Twenty-five fields of view (one field of view: 0.04 $mm^2$) were photographed. The photograph was subjected to image analysis to measure the number of intermetallic compounds and the particle diameter.

TABLE 3

| Specimen | Alloy | Production condition | Average grain size (μm) | Pb concentration (times) | Precipitate distribution (/$mm^2$) 10 μm or less | More than 10 μm |
|---|---|---|---|---|---|---|
| 1 | A | a | 38 | 230 | 6100 | 1 |
| 2 | B | b | 43 | 290 | 6350 | 5 |
| 3 | C | c | 49 | 360 | 4780 | 20 |
| 4 | D | a | 48 | 250 | 7300 | 55 |
| 5 | E | b | 41 | 110 | 8130 | 70 |
| 6 | F | c | 39 | 370 | 7980 | 12 |
| 7 | A | d | 82 | 460 | 6640 | 0 |
| 8 | A | e | 72 | 5 | 5250 | 1 |
| 9 | A | f | Not recrystallized | 120 | 4260 | 0 |
| 10 | A | g | 105 | 200 | 8100 | 20 |

(Note)
Average grain size: average grain size in the surface area in the direction perpendicular to the rolling direction The presence or absence of a non-uniform pattern and streaks on the specimen (cold-rolled product) was observed, and an unetched area and etch pit uniformity were evaluated by the following methods. The results are shown in Table 4.

The cold-rolled product was subjected to degreasing (solution: 5% sodium hydroxide, temperature: 60° C., time: 10 seconds), neutralization (solution: 10% nitric acid, temperature: 20° C., time: 30 seconds), an alternating-current electrolytic surface-roughening treatment (solution: 2.0% hydrochloric acid, temperature: 25° C., frequency: 50 Hz, current density: 60 A/$dm^2$, time: 20 seconds), a desmut process (solution: 5% sodium hydroxide, temperature: 60° C., time: 5 seconds), and an anodizing process (solution: 30% sulfuric acid, temperature: 20° C., time: 60 seconds). The product was then washed with water, dried, and cut to a specific size to prepare a specimen.

The presence or absence of a non-uniform pattern and streaks of each specimen was observed. The surface of the specimen was observed using a scanning electron microscope (SEM) at a magnification of 500. The surface of the specimen was photographed so that the field of view was 0.04 $mm^2$. An unetched area and etch pit uniformity were evaluated based on the resulting photograph.

Presence or absence of non-uniform pattern: A case where a non-uniform pattern was observed on the surface of the specimen with the naked eye was evaluated as "Bad", and a case where a non-uniform pattern was not observed was evaluated as "Good".

Presence or absence of streaks: A case where streaks were observed on the surface of the specimen with the naked eye was evaluated as "Bad", and a case where streaks were not observed was evaluated as "Good".

Evaluation of unetched area: A case where the percentage of an unetched area exceeded 20% was evaluated as "Bad", and a case where the percentage of an unetched area was 20% or less was evaluated as "Good".

Evaluation of etch pit uniformity: A case where the area ratio of large pits with a circle equivalent diameter exceeding 10 μm was more than 10% with respect to all pits was evaluated as "Bad", and a case where the area ratio was 10% or less was evaluated as "Good".

TABLE 4

| Specimen | Unetched area | Pit uniformity | Non-uniform pattern | Streaks |
|---|---|---|---|---|
| 1 | Good | Good | Good | Good |
| 2 | Good | Good | Good | Good |
| 3 | Good | Good | Good | Good |

TABLE 4-continued

| Specimen | Unetched area | Pit uniformity | Non-uniform pattern | Streaks |
|---|---|---|---|---|
| 4 | Good | Good | Good | Good |
| 5 | Bad | Bad | Good | Good |
| 6 | Bad | Bad | Good | Good |
| 7 | Good | Good | Bad | Bad |
| 8 | Good | Good | Bad | Bad |
| 9 | Good | Bad | Bad | Bad |
| 10 | Bad | Bad | Good | Good |

As shown in Table 4, Specimens 1 to 4 according to the present invention did not produce a non-uniform pattern and streaks, exhibited excellent etching properties after an electrolytic treatment, and had uniform etch pits over the entire surface.

On the other hand, Specimen 5 could not be sufficiently surface-roughened during an electrolytic treatment due to low Mg content. Specimen 6 could not ensure pit uniformity during an electrolytic treatment due to high Mg content.

Since Specimen 7 was produced with a long holding time from the completion of rough hot rolling to finish hot rolling, coarse recrystallized grains were partially produced due to the growth of recrystallized grains, whereby minute recrystallized grains could not be obtained at the time of completion of hot rolling. Moreover, a specific Pb concentration was not obtained. Since Specimen 8 was produced with a short holding time from the completion of rough hot rolling to finish hot rolling, a uniform recrystallized structure could not be obtained in the surface portion of the sheet material due to insufficient recrystallization. Moreover, a specific Pb concentration was not obtained. As a result, a non-uniform pattern and streaks were observed. In addition, Specimen 8 exhibited poor etch pit uniformity.

Specimen 9 produced a non-uniform pattern and streaks since the finish temperature of finish hot rolling was low and non-recrystallized portions occurred due to insufficient recrystallization. Specimen 11 also showed pit non-uniformity during an electrolytic treatment. Since Specimen 10 was homogenized at a low temperature, precipitation of Fe and Si was insufficient, whereby the pit pattern formed during an electrolytic treatment was non-uniform, and an unetched area was observed.

What is claimed is:

1. An aluminum alloy sheet for a lithographic printing plate consisting essentially of, in mass %, 0.03 to 0.15% of Si, 0.2 to 0.6% of Fe, 0.005 to 0.05% of Ti, less than 0.05% of Mg and 2 to 30 ppm of Pb, with the balance being aluminum and unavoidable impurities, the aluminum alloy sheet having an average recrystallized grain diameter of 50 μm or less in a surface area in a direction perpendicular to a rolling direction and a Pb concentration of 100 to 400 times an average Pb concentration in a surface area up to a depth of 0.2 μm from the surface of the aluminum alloy sheet.

2. The aluminum alloy sheet according to claim 1, further comprising 0.05% or less of Cu.

3. The aluminum alloy sheet according to claim 1, wherein the number of precipitates having a particle circle equivalent diameter of 1 to 10 μm and the number of precipitates having a particle circle equivalent diameter of more than 10 μm distributed in a matrix are 4000 to 10,000 per square millimeter and 100 or less per square millimeter, respectively.

4. The aluminum alloy sheet according to claim 2, wherein the number of precipitates having a particle diameter of 1 to 10 μm and the number of precipitates having a particle diameter of more than 10 μm distributed in a matrix are 4000 to 10,000 per square millimeter ($mm^2$) and 100 or less per square millimeter ($mm^2$), respectively.

5. A method of producing an aluminum alloy sheet for a lithographic printing plate comprising homogenizing an ingot of the aluminum alloy according to claim 1 at 500 to 610° C. for one hour or more, subjecting the homogenized product to rough hot rolling, a start temperature of the rough hot rolling being 430 to 500° C. and a finish temperature of the rough hot rolling being 400° C. or more, holding the product subjected to the rough hot rolling for 60 to 300 seconds after completion of the rough hot rolling to recrystallize the surface of the product, subjecting the resulting product to finish hot rolling that is finished at 330° C. or more, and cold-rolling the resulting product at a reduction ratio of 80% or more.

* * * * *